US005691004A

United States Patent [19]

Palazzolo et al.

[11] Patent Number: 5,691,004

[45] Date of Patent: Nov. 25, 1997

[54] METHOD OF TREATING LIGHT METAL CYLINDER BORE WALLS TO RECEIVE THERMAL SPRAYED METAL COATINGS

[75] Inventors: Christopher K. Palazzolo, Ann Arbor; V. Durga Nageswar Rao, Bloomfield; Barry E. Shepley, Novi, all of Mich.

[73] Assignee: Ford Global Technologies, Inc., Dearborn, Mich.

[21] Appl. No.: 678,310

[22] Filed: Jul. 11, 1996

[51] Int. Cl.[6] ..... C23C 4/02; C23C 4/06

[52] U.S. Cl. ..... 427/455; 427/456; 427/236; 427/328; 427/292

[58] Field of Search ..... 427/446, 456, 427/451, 449, 236, 328, 455, 292

[56] References Cited

U.S. PATENT DOCUMENTS

| | | | |
|---|---|---|---|
| 2,558,286 | 8/1951 | Albertson . | |
| 2,588,422 | 3/1952 | Shepard | 427/236 |
| 2,833,668 | 6/1958 | Dailey et al. . | |
| 2,976,169 | 4/1961 | Streicher . | |
| 3,010,843 | 4/1961 | Eder . | |
| 3,011,907 | 12/1961 | Davis et al. . | |
| 3,012,904 | 12/1961 | Baer et al. . | |
| 3,295,198 | 1/1967 | Coan . | |
| 3,338,733 | 8/1967 | Rowady . | |
| 3,791,861 | 2/1974 | Sundahl, Jr. . | |
| 4,685,778 | 8/1987 | Pollock | 350/600 |
| 5,080,993 | 1/1992 | Maruta et al. | 430/128 |
| 5,271,967 | 12/1993 | Kramer et al. | 427/455 |
| 5,358,753 | 10/1994 | Rao et al. | 427/456 |
| 5,376,410 | 12/1994 | MacKelvie | 427/290 |
| 5,380,564 | 1/1995 | VanKluiken, Jr. et al. | 427/456 |
| 5,622,753 | 4/1997 | Shepley et al. | 427/453 |

*Primary Examiner*—Katherine A. Bareford
*Attorney, Agent, or Firm*—Joseph W. Malleck

[57] ABSTRACT

A method of treating a light metal cylinder bore wall to adherently receive a thermally sprayed metallic coating, that comprises (a) honing the wall to produce a net cylinder shape surface by use of spiral overlapping cross-abrasions having certain peaks and valleys of the abrasions folded over and molded to create tears, folds and undercuts rendering a hook and ladder effect, the honing being carried out with the use of a machining coolant to prevent burnishing of the walls; (b) either concurrently or shortly after step (a), washing the honed surface with a hot alkaline solution comprising (i) a non-soaping aluminate forming agent (sodium xanthate) that produces a residue on the walls, and (ii) surfactants that facilitate wetting of the walls even when some steam bubbles may be present; (c) rinsing the washed surfaces without disturbing the residue; and (d) thermally spraying a metallic bond coat and top coat on the honed and washed surface to render adhesion between the coating and prepared surface that is at least 6000 psi.

8 Claims, 2 Drawing Sheets

METHOD OF TREATING LIGHT METAL CYLINDER BORE WALLS TO RECEIVE THERMAL SPRAYED METAL COATINGS

TECHNICAL FIELD

This invention relates to the technology of bonding thermally sprayed metallic coatings to metallic surfaces and more particularity to enhancing such bond for applications experiencing severe operating conditions.

DISCUSSION OF THE PRIOR ART

Machining with oily coolants has been the norm for surface preparation of metal substrates. There has been some early attempts by the prior art to roughen steel or iron to accept coatings surfaces by honing followed by degreasing and cleaning immediately prior to coating, the coatings were comprised of soft low melting metals such as tin or lead. However, iron or steel does not present the bonding problem that is presented by light weight metals, such as aluminum, which possesses a tenacious oxide film. Aluminum substrates, particularly those to be used in very severe operating conditions, such as in a cylinder chamber of an internal combustion engine, present a very challenging problem for adhesion of coatings to the prepared surface. Formation of aluminum oxide on any exposed aluminum surface normally inhibits chemical or mechanical bonding of the superimposed metallic coating irrespective of the type of thermal spraying employed.

To prepare aluminum for bonding a thermally sprayed metal, it is known to sequentially (i) vapor degrease the metal surfaces containing oils and grease that result from exposure to cooling fluids used during machining of the surface, and (ii) roughen the surface such as by grit blasting, etching, water jetting, or threading (See U.S. Pat. No. 3,380,564). However, this combination of steps does not thoroughly protect the aluminum against the oxide film that aggressively reappears, even after strong roughening, thus resulting in low bond strengths. Such oxide will inhibit the chemical bonding of any metallic coating, even metals that are aggressively attracted to aluminum based materials. To rely only on mechanical adherence, achieved through roughening, without also severely disrupting or removing the chemical film on the parent metal surface, not only leads to increased coating expense and disaligned coatings, but usually results in low bond strengths.

What is needed is an economical and effective method that prepares light weight metal cylinder bores to enhance the bonding strength between thermally sprayed metallic coatings and the interior surface of such substrate; the method should provide a synergistic mechanical/chemical improvement in the adherence of the coating to the substrate between.

SUMMARY OF THE INVENTION

The invention, meeting the above object, is a method of treating a light metal cylinder bore wall to adherently receive a thermally sprayed metallic coating, that comprises (a) honing the wall to produce a net cylinder shape surface oxide by use of spiral overlapping cross-abrasions having certain peaks and valleys of said abrasions folded over and molded to create tears, folds and undercuts rendering a hook and ladder effect, the honing being carried out with the use of a machining coolant to prevent burnishing of the walls; (b) either concurrently or shortly after step (a), washing the honed surface with a hot alkaline solution comprising (i) a non-soaping aluminate agent that produces a protective residue on the walls, and (ii) surfactants that facilitate wetting of the walls even when some steam bubbles may be present; (c) rinsing the washed surfaces without disturbing said residue; and (d) thermally spraying a metallic bond coat on said honed and washed surface to render a adhesion between said coating and prepared surface that is at least 2800 psi.

The washing solution preferably contains an aluminate forming agent that consists of sodium xanthate hydroxide or meta silicate, which may be fluoro siliconized; the alkalinity agent may comprise anionic hydroxides or meta silicates of sodium or potassium; the surfactants may comprise nonionic fluoronated hydrocarbons such as Fluorad® produced by 3M company, and the solutions may comprise non-soaping and non smutting agents such as octoates of sodium and potassium, and hydrocarbons such as sodium gluconate.

DETAILED DESCRIPTION AND BEST MODE

Figure 1:
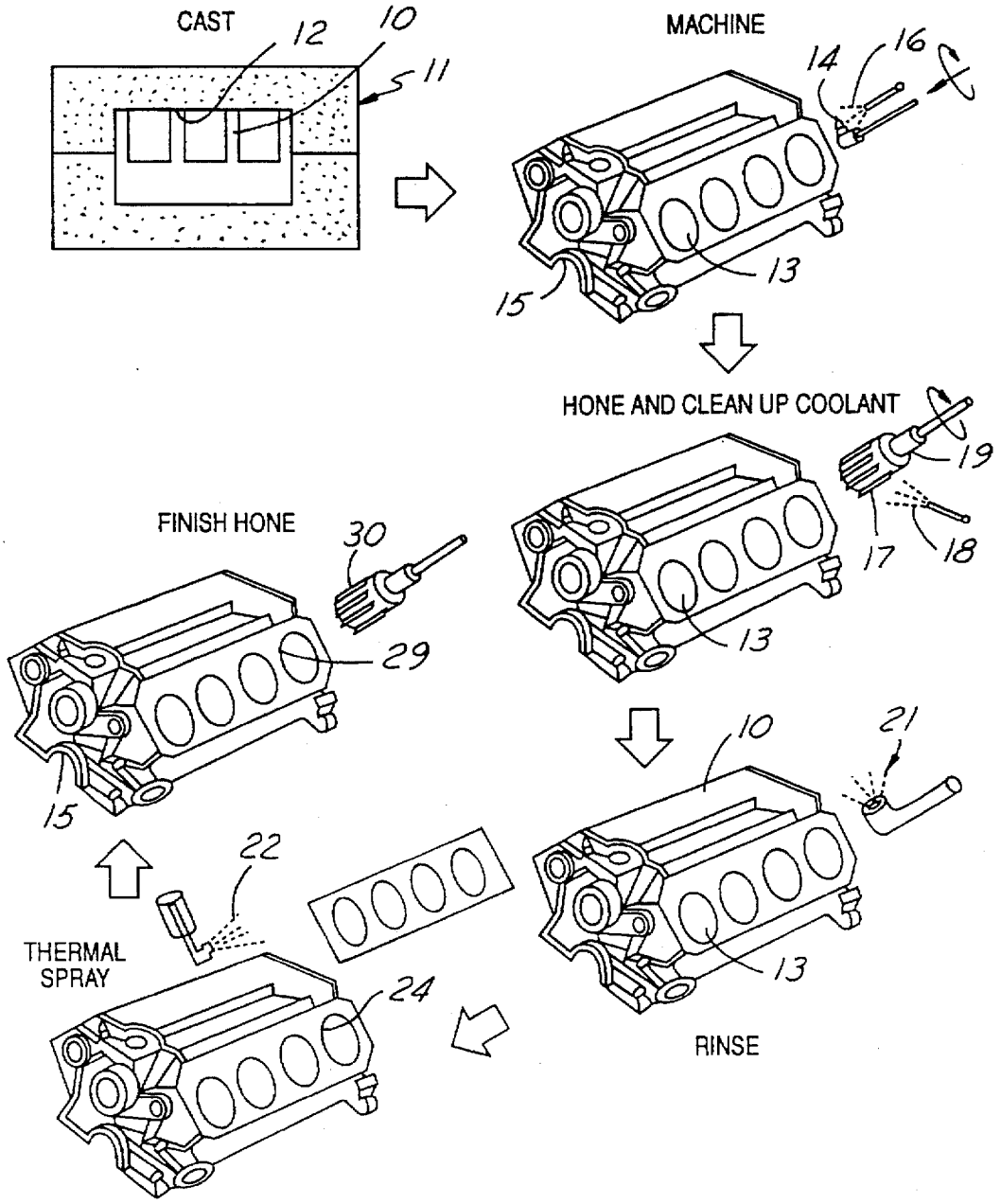
FIG. 1 is a process flow diagram of a preferred mode of carrying out this invention.

As shown in FIG. 1, a light weight metal casting 10 of aluminum, titanium or magnesium is first made, such as in the form of an aluminum or aluminum alloy engine block. The casting can be made by injection or gravity flow techniques using a mold 11 that is comprised of permanent or recyclable mold parts. The character of the mold surface 12 can speed or slow down the cooling rate of the molten aluminum alloy to achieve a desired microstructure in the solidified metal, such as at the bore as-cast cylinder bore surface 13, to better meet service conditions. The as-cast surface will usually have a surface finish of about 5–20 μm Ra or preferably 1.2–1.5 μm Ra.

Surface 13 is usually machined or milled using a single point cutting tool 14 to provide a net shape cylinder bore surface that is geometrically aligned with the crank bearing surface 15 and has a surface finish of 0.5–50 μm Ra. Such machining is usually accompanied by the use of commercial cooling fluids 16 which are sprayed directly onto the tool and surface during the cutting operation. Such cutting fluid contains grease and oils in a fluid carrier that leaves an oily film on the machined surface 16 which retards oxidation of the exposed machined surface. However, if such film is not removed, it too will inhibit proper adhesion and bonding of any metalized coating on the machined aluminum surface. Aluminum substrates, particularly those to be used in very severe operating conditions (a cylinder chamber of an internal combustion engine) present an adhesion problem. Aluminum oxide on any exposed aluminum surface to be coated will inhibit chemical or mechanical bonding of a superimposed metallic coating irrespective of the type of thermal spraying employed.

This invention uniquely prepares the machined aluminum surface for thermal spraying by concurrently or sequentially (i) honing the substrate in a manner to produce spiral overlapping cross-abrasions that create peaks and valleys with at least some of the peaks being folded over and molded to create tears, holes, and undercuts rendering a hook and ladder effect, and (ii) washing the honed surface with an alkaline aluminate-forming solution that leaves a protective residue on the exposed aluminum surface.

To carry out honing, a radially expandable holder carrying the plurality of honing 17 stones may be used, as shown in FIG. 1, which lightly brings the stones against surface 13 as the tool rotates and reciprocates flushed by machining fluid 18. As many as eight honing stones are employed, each having an outer surface with a radius complementary to the internal radius of the cylinder bore surface 13 of the aluminum block that is being honed. The material of the stones is preferably comprised of a powder metal bond containing abrasive particles of a size randomly ranging from about 40 to 1300 micrometers. The abrasive particles preferably consist of diamond, but can be any hard material such as silicon carbide, aluminum oxide, boron nitride etc., which are effective in abrading an aluminum surface. Diamond is harder and longer lasting with sharp edges, while silicon carbide is a better conductor of heat than aluminum oxide and fractures more easily, providing new cutting surfaces that extend the useful life of the abrasive.

The honing tool 19 is inserted and rotationally and reciprocally moved to carry the plurality of honing Stones against the bore surface with a pressure of about 30–150 psi. Enough pressure must be used to cut aluminum, which is generally found to be at least 30 psi. The movement of the honing stones can be controlled by use of an industrial honing machine wherein the honing head is pneumatically lowered and raised along a path for reciprocation,; each contact area (particle edge) of each stone will undergo both rotation and reciprocation along the stroke path.

The stones effect a pattern of spiral overlapping abrasions or scratches on the surface. For example, each particle, when in contact with the surface, will plow a micro-sized, non-smooth and irregular shaped groove in the aluminum surface which results in a spiral peak and valley along the direction of movement of the particle. Upon repeated reciprocation rotation, there will be overlapping grooves and cross abrading of the prior peaks and valleys at intersections which is then accompanied by a molding and folding over of certain of the prior peaks and valleys to create the irregular micro-sized tears or fold and undercuts. The abrasive particles are random in grit size (30–400 U.S. mesh) to effect the irregular spacing of the grooves or scratches, and the abrasive particles will be jagged at the point of contact with the surface to effect non-smooth side walls or valleys for each of such grooves. The stones are preferably moved at a surface speed of about 50–200 sfm.; the rate of plowing of the material is usually 0.0075 in.$^3$/in./min.; and the number of grains concentrated in the stone is generally about 30–50 carat weight for diamond. The resulting honed surface or roughened finish of the aluminum surface will be in the range of about 0.5–17 micrometers. For example, if 600 grit honing stones are used, a surface finish of 15 $R_a$ will result.

With the surface topographically roughened, it is then washed with a cleanup solution 20. Such solution can be used as the coolant 18 during the honing step or as an independent spray wash liquid after honing has been completed; spray washing is desirable because it uses considerably less solution or water than other methods. The washing solution is chemically constituted of a water based liquor that has (a) an alkalinity building agent such as hydroxide of sodium or potassium, sodium or potassium meta silicate, dodium bicarbonate or sodium phosphate present in an amount to create an alkaline condition of about 10–10.5 pH;; (b) an aluminate forming agent such as sodium xanthate hydroxide which may be fluoro siliconized (c) surfactants, such as non-ionic low foaming flurorated hydrocarbons and non-soaping low foaming agents such as octoates of sodium and potassium hydrocarbons, and sodium gluconate, and (d) non-smutting nonionic agents such as sodium carbonate. The solution is used at a temperature in the range of 120°–160° F. (preferably about 140° F.) and sprayed at a pressure of about 5–30 psi because the applied pressure will clean out the pores of the aluminums surface and facilitate removal of any surface film without erosions.

The clean-up solution is mildly alkaline to protect the fresh surface from oxidation (pH about 10–10.5); the solution is a no etch cleaner is inhibited and contains nonionic and anionic surfactants. The aluminate forming agent is important because it leaves a scum-like residue on the honed aluminum surface that is easily vaporized upon impact of the subsequent thermal spraying material. The residue prevents oxygen molecules from making contact with the aluminum surface and thereby will protect the aluminum from oxide formation thereon for a period of up to about 48 hours.

Although a single use of the clean-up solution should be followed by a rinse 21 to obtain the benefits of this invention, a commercial washing line may repeat the operation to insure a higher degree of protection. For example, the initial clean-up wash may be carried out by spraying the clean-up solution at 150° F. for 2 minutes using a ⅜ inch nozzle opening at a pressure of about 20 psi, delivering about 200 gallons per minutes. This is immediately followed by a water rinse 21 at 130° F. for about 40 seconds using a nozzle spray opening of 1¼ inch at 20 psi delivering about 170 gallons per minute. The clean-up wash may then be repeated for another 60 seconds at the same temperature, pressure and water flow as previously described, and then followed with a rinse 21 at the previous rinse temperature, and pressure but using a slightly smaller nozzle opening such as ⅜ inch, to deliver less water (100 gallons per minute). This again may then be followed by at third rinse 21 at ambient temperature for about 40 seconds at about 20 psi using a 1¼ inch spray nozzle opening giving a flow rate of 170 gallons per minute. The hot temperature of the clean-up solution and of the rinse helps to penetrate the oil and soil deposits in and on the part surfaces; leaving only a film that prevents oxygen diffusion to the fresh metal surface.

Figure 2:
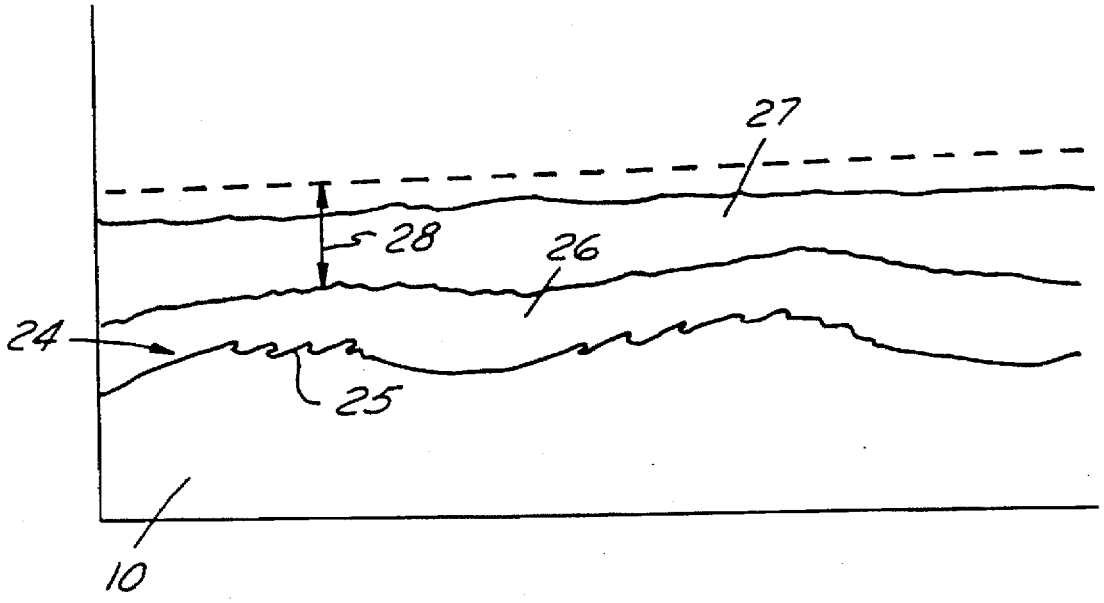
FIG. 2 is an enlarged schematic diagram of the peaks and valleys created by the honing step and also showing the mechanical and metallurgical bond with the thermal spray coating thereon.

Thermal deposition is then carried out to form a mechanical and chemical lock of sprayed particles 22 to the prepared surface 24. Mechanical adherence is achieved by the migration of the sprayed particles into the irregular texture and undercuts 25 (see FIG. 2) during thermal deposition as a result of the force of impact as well as the semi-fluid character of the particles upon contact with the aluminum surface. Migration into the undercut and irregular texture will create a mechanical adherence of the coating to the work piece surface. Chemical adherence is achieved by use of a thermal spray material that has a metallurgical affinity for the substrate (a bond coat 26). Materials for such bond coat may comprise 90% Ni/10% Al (by weight), or 95% bronze/5% Al, or 80% Ni/20% Cr.

Thermal spraying may be carried out by powder plasma or wire arc techniques each of which propel semi-melted or fully melted particles onto the target surface 24 of the substrate at a velocity of 50–200 feet per second at a disposition rate of up to 20 pounds per hour. The technique for powder plasma thermal spraying essentially comprises striking an arc between an anode within a cathode nozzle through which is a gas flow to form a plasma stream; powder feedstock is injected into the plasma stream which melts at least the shell of each particle and thrust them as a spray into the direction of gas flow.

For wire arc thermal spraying, the process comprises feeding one or more solid wire feedstocks down a rotatable and reciprocal journal shaft to the wire tip(s) for promoting an arc through which a gas can be projected. Electrical current from a power source is passed through the wire to create an arc across the gap, while pressurized gas is directed through the gap to spray fully molten droplets from the wire tip(s). The droplets are projected as a result of the force of the gas onto the sprayed target.

Following the deposition of the bond coat (usually in a thickness of 0.002–0.006 inches), the final or preferred top coat 27 is then applied by thermal spray. The top coat may consist of a material that is selected for both its lubricity and wear resistance. For the powder plasma technique, the material may consist of ferritic stainless steel mixed with nickel encapsulated BN, or a powder of Fe—C—O containing up to 0.1–0.5% (wt.) carbon and 0.2–2.0% oxygen (the latter being at least 80% in the form of FeO). In the case of the wire arc spraying technique, the feedstock material may comprise a low alloy steel wire such as 1010 low carbon steel. The top coat 27 is applied in a thickness, 28 typically 150–300 μm for powder spraying (that is respectively 0.006–0.010 inches) Finish honing 30 is then employed to remove only about 50–150 micrometers (0.002–0.006 inches) to create a final smoothed surface 29 (0.1–0.4 micron Ra) that is aligned concentrically with the crank bore surface 15.

Use of rough honing, use of a washing and residue leaving solution and use of a bond coat create a synergistic adherence effect. If the prior honing step were to be eliminated and only the and washing leaving residue solution and bond coat were to be utilized in preparing the substrate, the resultant adherence, determined by a conventional adherence test (e.g. ASTM 313), would be about 3000–5000 psi. If the bond coat is eliminated and only rough honing and the washing and residue leaving solution employed, adherence of the top thermally sprayed coat to such a prepared surface would be in the range of 2500–3500 psi and would likely peal in operation when used in an engine block. If the washing and residue leaving solution step were eliminated and only rough honing and a bond coat employed, adherence of the thermally sprayed top coat to the substrate would be about 500–1500 psi. This should be compared directly to the adherence values obtained when those three features are used in combination, creating a synergistic improvement in adherence to 6000–8000 psi.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of treating light metal cylinder bore walls to adherently receive a thermally sprayed metallic coating thereon, said treatable walls carrying a film of grease or oil resulting from machining operations, comprising; (a) honing said walls to produce a near net shape cylinder surface having spiral overlapping cross-abrasions with some peaks and valleys folded over and molded to create surface tears, folds or undercuts rendering a hook and ladder effect, said honing being carried out with the use of a machining coolant to prevent burnishing of said walls; (b) either concurrent therewith or following step (a), washing said honed surface with a mildly alkaline solution comprising (i) an aluminate forming agent that produces an aluminate residue oh the walls and (ii) surfactants that provide for wetting of the walls even when steam is present in the solution; (c) rinsing the washed surface to remove the solution except for said residue; and (d) thermally spraying onto said washed and rinsed surface a metalized bond coat that is sprayed with sufficient velocity, impact and heating of the sprayed particles to promote migration of such particles into said tears, folds and undercuts for mechanical interlocking with said honed surface as well as chemical metallurgical interaction with said prepared surface through said residue; and (e) thermally spraying a top coat onto said bond coat which has increased wear resistance and has lubricity.

2. The method as in claim 1, in which said solution contains alkalinity builders selected from the group comprising sodium hydroxide, potassium hydroxide, sodium or potassium meta silicates, sodium bicarbonate and sodium phosphate.

3. The method as in claim 1, in which said aluminate forming agent is sodium xanthate hydroxide.

4. The method as in claim 1, in which said aluminate forming agent is a fluro siliconized compound.

5. The method as in claim 1, in which said washing solution is maintained at a temperature of 120°–160° F. and is sprayed at a pressure of about 5–30 Psi.

6. The method as in claim 1, in which said walls prior to the honing step are machined by a single point milling tool to a surface finish of 0.5–50 micron $R_a$ and the milled surface is thereby aligned about a predetermined axis determined by the tool.

7. The method as in claim 1, in which the cylinder bore walls are constituted of aluminum or aluminum alloy and the resultant coated product has an adhesion of the coatings to the substrate which is in a range of 6000–8000 psi as tested by the ASTM 313 method.

8. The method as in claim 1, in which said washing solution also contains nonionic surfactants to provide a low foaming characteristic and a non-smutting agent.

* * * * *